United States Patent [19]

Frechin et al.

[11] 4,152,849

[45] May 8, 1979

[54] SKI BOOT

[75] Inventors: Jean-Paul Frechin, Chamonix; Andrea Gabrielli, Cluses, both of France

[73] Assignee: The Garcia Corporation, Teaneck, N.J.

[21] Appl. No.: 815,053

[22] Filed: Jul. 12, 1977

[30] Foreign Application Priority Data

Jul. 19, 1976 [FR] France ..... 76 22463

[51] Int. Cl.[2] ..... A43B 5/04; A43B 3/00

[52] U.S. Cl. ..... 36/120; 36/1.5

[58] Field of Search ..... 36/117, 118, 119, 120, 36/121, 109, 1.5

[56] References Cited

U.S. PATENT DOCUMENTS

| | | | |
|---|---|---|---|
| 3,303,584 | 2/1967 | Werner et al. | 36/120 |
| 3,732,635 | 5/1973 | Marker | 36/120 |
| 4,044,478 | 8/1977 | Girard | 36/1.5 |

FOREIGN PATENT DOCUMENTS

| | | | |
|---|---|---|---|
| 2340622 | 4/1974 | Fed. Rep. of Germany | 36/121 |
| 1817978 | 1/1976 | Fed. Rep. of Germany | 36/120 |

*Primary Examiner*—Patrick D. Lawson

*Attorney, Agent, or Firm*—Fitzpatrick, Cella, Harper & Scinto

[57] ABSTRACT

A ski boot shell has a foot encasing portion and a separate ankle encasing portion. A locking arrangement secures the two portions together with their mating edges overlapping after the wearer's foot has been inserted therein.

8 Claims, 5 Drawing Figures

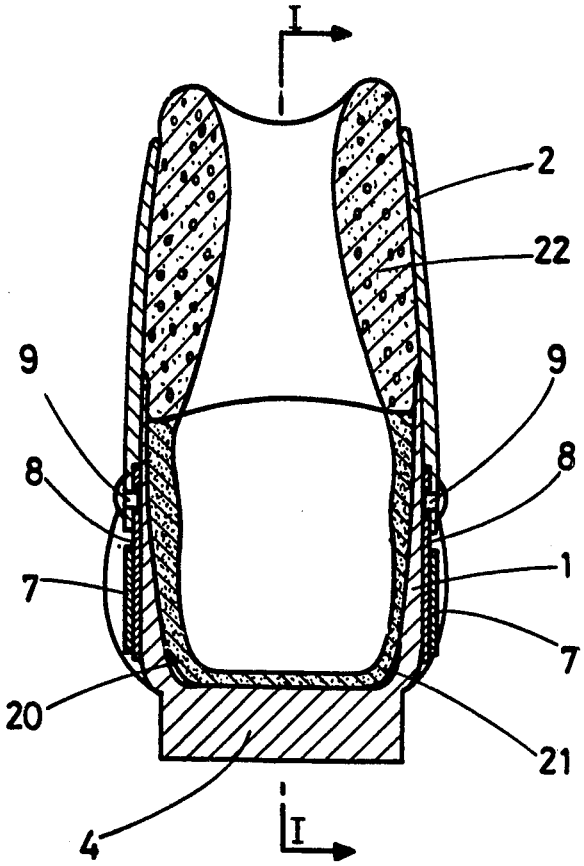
FIG. 3
FIG. 4
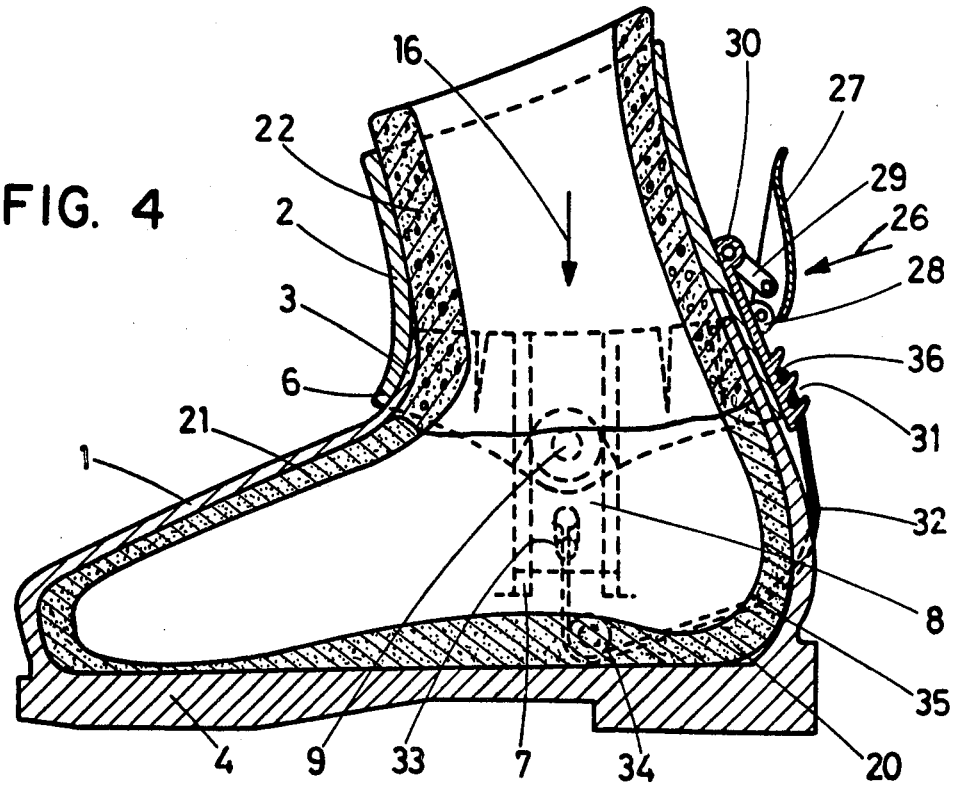

SKI BOOT

BACKGROUND OF THE INVENTION

The present invention relates generally to athletic boots, and, more specifically to a ski boot construction which does not require the standard plurality of buckles arranged on opposed closure flaps for securing the boot tightly about the wearer's foot.

In a known ski boot, such as the one described in U.S. Pat. No. 3,645,017, the upper part of the vamp is articulated on a hinge placed vertically on one of the sides of the boot, buckles being provided on the other side to latch the upper part of the vamp in closed position in front of the ankle. Furthermore, one or more other buckles are provided on the instep to keep the foot itself tight in the boot. Such a boot has the disadvantage of taking a relatively long time to put on, since several buckles have to be latched. Moreover, it is difficult to obtain good water tightness, for the seam between the vamp and the top on which the vamp is articulated is approximately vertical; and snow and water can seep inside the boot notwithstanding the overlap of the shell elements.

In another known device as described in U.S. Pat. No. 3,793,749, there is only one buckle to work. However, there is a rather complicated cable system which is subject to damage and there are also several seams which prevent a water leakage problem as in the above noted device.

In yet another boot described in French Pat. No. 2,276,851, the whole back part of the top is articulated to the sole on an axis transverse to the latter. The boot is put on from the back. There is, therefore, an approximately vertical seam which leads to the aforementioned water seepage problem. In addition, two buckles have to be latched to put the boot on.

SUMMARY OF THE INVENTION

A boot according to the present invention avoids the above-mentioned disadvantages of the prior art yet is of a very simple structure and can be put on and taken off very rapidly and easily, while assuring very good water tightness.

In accordance with the invention, a boot has a first part, dimensioned to encase the wearer's foot and comprising the sole and the lower part of the boot. A second generally cylindrical part, vertically displaceable in relation to the first, is dimensioned to encircle the wearer's ankle and lower leg and constitutes the upper part of the boot. The second part on its lower periphery, has a conical lower interior edge designed to overlap a conical upper edge of corresponding shape provided on the first part. Means are provided to releasably lock the second part supported on the first. The lower edge of the second part and/or the upper edge of the first are advantageously, but not necessarily, feathered on at least part of their periphery in order to facilitate deformation upon connection of the two parts. Moreover, the overlapped area of the upper edge of the first part may have a plurality of notches which further enhances local deformation.

An inner liner may also be provided. In such case the liner preferably consists of two regions; a lower first region is designed to encompass the wearer's foot and an upper second region is designed to encircle the wearer's ankle; the second region being made of a more elastic and compressible material than the first.

The mechanism provided to keep the second part of the boot supported on the first consists, for example, of two at least approximately vertical guides respectively provided on both sides of one of the two parts of the boot. Slides dimensioned to mate the guides are provided on both sides of the other part of the boot. A locking device is further provided in association with the guides to releasably secure the slides therewithin. According to one embodiment, the locking device consists of at least one spring bolt, displaceable substantially perpendicularly to the guides, supported by one of the two parts of the boot. Such bolt has a series of teeth dimensioned to mesh with teeth provided on a mating slide parallel to the guides. The teeth are inclined in order to permit automatic hooking on putting on the boot. According to another embodiment, the locking device consists of a tensioning element secured to the back of the boot on one of its two parts. The tensioning element is connected to the lower edge of both slides by at least one flexible cable. Guide means are provided for the flexible cable to guide the latter from the tensioning element to the respective slides.

There has thus been outlined, rather broadly, the more important features of the invention in order that the detailed description thereof that follows may be better understood and in order that the present contribution to the art may be better appreciated. There are, of course, additional features of the invention which will be described hereinafter and which will form the subject of the claims appended hereto. Those skilled in the art will appreciate that this invention may be utilized as a basis for designing other structures for carrying out the several purposes of the invention. It is, therefore, important that the claims be regarded as including such equivalent constructions as do not depart from the spirit and scope of the invention.

BRIEF DESCRIPTION OF THE DRAWINGS

Several embodiments of the invention have been chosen for purposes of illustration and description, and are shown in the accompanying drawings forming a part of the specification wherein:

FIG. 3 is a transverse cross-sectional view taken along lines III—III of FIG. 2;

FIG. 4 is a longitudinal cross-sectional view of a second embodiment of the invention.

DETAILED DESCRIPTION OF THE INVENTION

Figure 1:
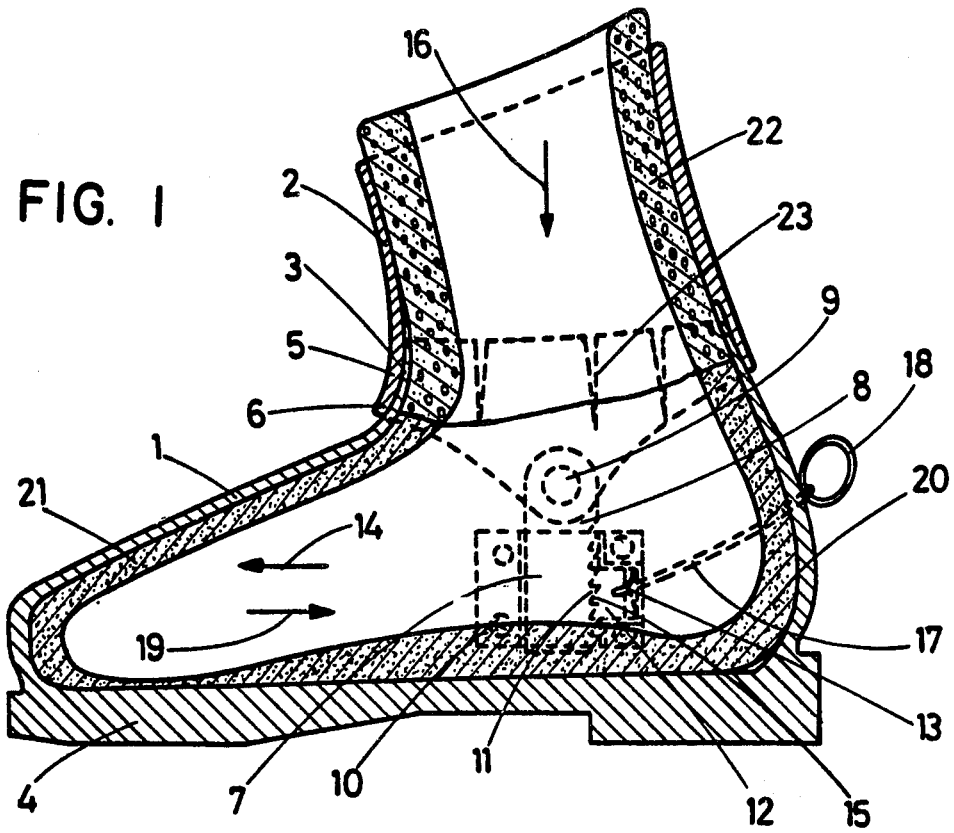
FIG. 1 is a longitudinal cross-section view taken along lines I—I of FIG. 3, illustrating a first embodiment of the invention.
Figure 2:
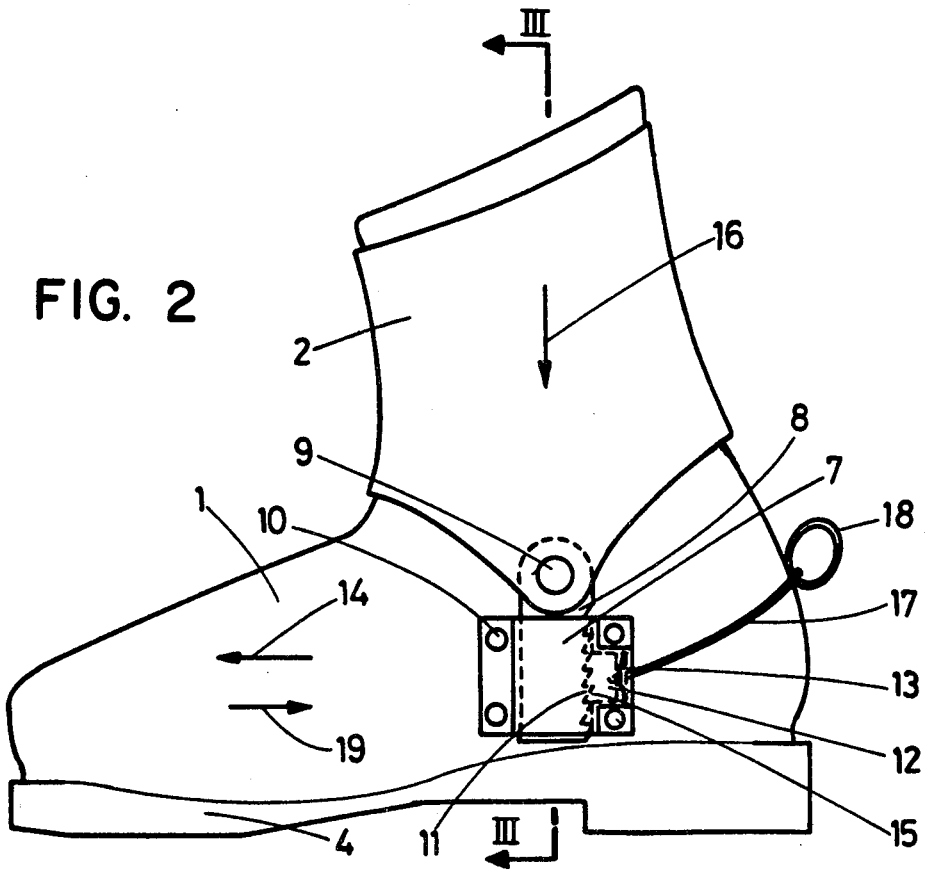
FIG. 2 is a side view of the ski boot of FIG. 1.

As illustrated in FIGS. 1 to 3, a ski boot according to the invention comprises a lower first part 1, including a sole 4, and an uninterrupted cylindrical upper second part 2. Lower part 1 has a conical upper edge 3 feathered down over most of its periphery and particularly in front. Upper part 2 contains a conical lower interior section 5, the edge 6 of which is, for example, relatively rigid. Conical section 5 is dimensioned to overlap the conical upper edge 3 of the lower 1. Edge 3 preferably includes a plurality of circumferential notches 23 which aid in the compression of edge 3 as the parts 1 and 2 of the boot are connected.

To secure the parts 1 and 2 together, guides 7 constructed, for example of folded steel to have a raised central area, is fastened by rivets 10 to set vertically parallel to each other on opposite side of lower 1. Into those guides 7 slides 8 of mating profile are positioned; each slide 8 being connected to opposite sides of upper part 2 of the boot by a rivet 9. The rivet connection permits a slight rotation of upper part 2 forward and backward.

To maintain each slide 8 in low position in guide 7, a spring bolt 12 is displaceably mounted perpendicularly to each guide 7. Spring 13 biases each bolt 12 in the direction of arrow 14 (FIGS. 1 and 2). Each bolt 12 is formed, at one end, with teeth 15 engaging teeth 11 provided on one edge of slide 8. Teeth 15 and 11 are angularly oriented so as to allow free displacement of each slide 8 downward in the direction of arrow 16, but prevents opposite displacement once the teeth are meshed. The other ends of bolts 12 are joined together by a flexible cable 17, the middle part of which supports a ring 18. A pull on ring 18 in the direction of arrow 19 simultaneously releases bolts 12 and teeth 11 and 15 allowing slides 8 to be withdrawn upwardly.

Preferably, the boot contains an inner liner 20 having two discrete sections. A lower first section 21 is constructed to encase the wearer's foot; and an upper second section 22 is constructed to encircle the wearer's ankle. Section 22 is advantageously made of a very elastic and compressible material such as elastic foam rubber or the like. The first section 21 may contain more incompressible padding such as denser foam rubber. As in known inner liners, a cover of fabric or like material, which may be stretchable particularly for the section 22 surrounds the padding of the liner.

To put the boot on, slides 8 are in a raised position in relation to lower part 1. Thus, when the wearer inserts his foot through the cylindrical upper part 2, upper section 22 of the liner is free to expand in every direction to permit passage of the foot. When the foot is in place, the wearer bears down on the top of the boot in direction 16, which has the effect of displacing upper part 2 of the boot downwardly in relation to lower part 1. During this displacement, teeth 11 successively push back teeth 15 of bolts 12 against the action of springs 13. The inclination of the teeth makes possible this displacement. At the same time, the displacement in the direction of arrow 16 of the conical lower area 5 of part 2 tends to compress the conical upper edge 3 of the lower 1. Upper part 22 of the liner is thus firmly seated against the wearer's foot which is kept tight in the boot. The rigid relative position of the two guides 7 correctly aligns the two slides 8 at the same time by the same number of teeth 11 for each. This assures a symmetrical position of both sides of upper part 2 of the boot.

In order to take the boot off, the wearer pulls on cable 17, by grasping ring 18 which simultaneously retracts bolts 12 and disengages teeth 11 and 15. Slides 8 are then displaced upwardly under the effect of the elastic tension of the liner and of parts 1 and 2 of the boot. Part 22 of the liner is thus free to expand in order to permit withdrawal of the wearer's foot.

Figure 5:
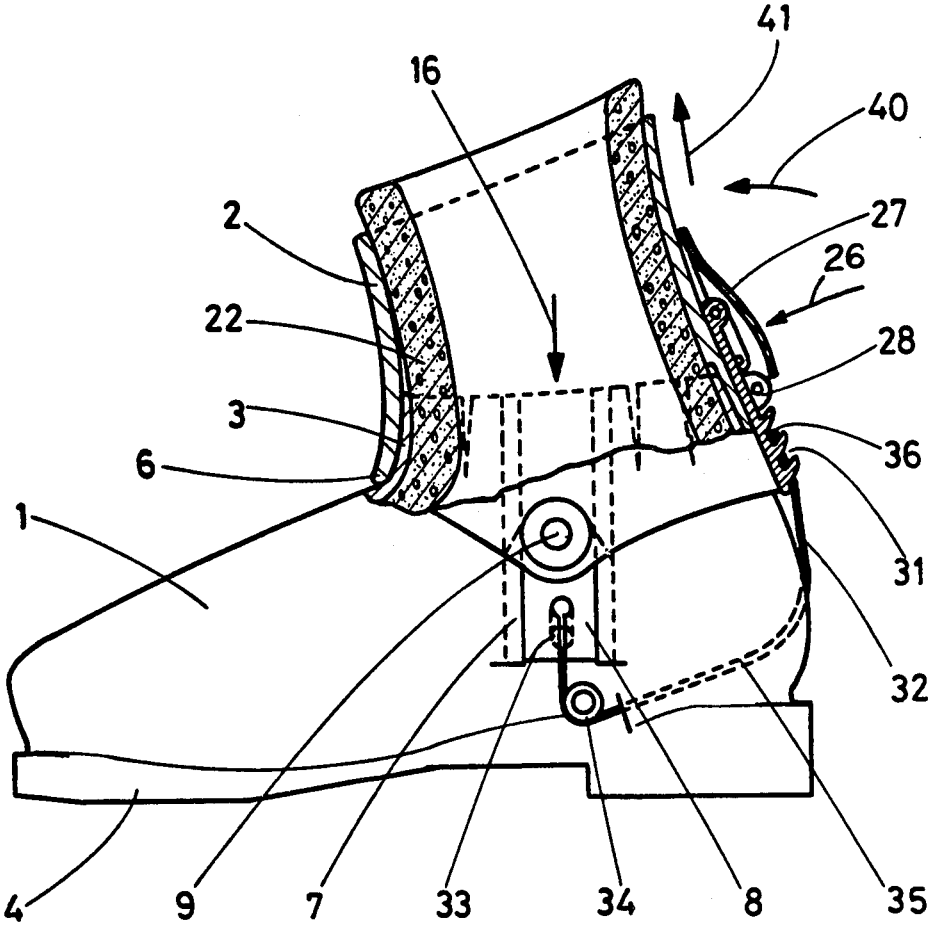
FIG. 5 is a side view partially in section of the ski boot of FIG. 4.

In a second embodiment of the invention, represented in FIGS. 4 and 5, the locking device consists of a tension device generally indicated by numeral 26 secured to the back of the boot, such as on upper part 2. This tension device comprises an operating lever 27 that works in a vertical plane set along the longitudinal axis of the boot, hinged at 28 on part 2. Lever 27 is connected by a rod 29 to an upper end 30 of a rack containing notches 31 at its other end. The rack is connected to the lower end of each slide 8 by a flexible cable 32, the end of which bears a plummet 33. Guide means are provided for each cable 32 such as a guide pulley 34 and a sheath 35 sunk in the thickness of the side wall of the heel of the boot. This tension device is adjustable, since the end of the two flexible cables 32 can be hooked to any of the notches 31 of the rack by means of a cable clamp 36. All of the other elements are identical to those described in the foregoing first embodiment.

To put the boot on, the wearer inserts his foot in the boot, as described above, when upper part 2 of the boot is in high position. Slides 8 are then also in high position with lever 27 being open and flexible ties 32 being slightly slack. All of the elements then occupy the position represented in FIG. 4. When the foot is in place in the boot, the wearer rotates operating lever 27 in the direction of arrow 40 which displaces connecting rod 29, end 30 of the rack and notches 31 in the direction of arrow 41. Cables 32 thus cause slides 8 to be displaced in the direction of arrow 16 to draw upper part 2 of the boot downwardly. The wearer's foot is thus kept tight in the boot in the same way as in the first embodiment. The different elements then occupy the position represented in FIG. 5. To take off the boot, operating lever 27 is rotated downwardly to release slides 8.

What is claimed is:

1. An athletic boot comprising:

a sole and integral lower foot encasing shell;

a generally cylindrical uninterrupted upper shell constructed to form an ankle and lower leg encircling portion, said shells having conical overlapping edges;

a downwardly extending slide element pivotally mounted on each side of the lower edge of said upper;

a guide mounted to each side of said lower, said guides being constructed and arranged to vertically receive said slides; and locking means associated with each of said slides and guides arranged to secure said slides in said guides and said upper and lower in mating fashion but to permit intentional release of said sides from said guides and vertical displacement of said upper in relation to said lower whereby said boot can be put on and removed.

2. An athletic boot according to claim 1 wherein the width of at least one of said mating edges of said shells is feathered down.

3. An athletic boot according to claim 1 wherein the upper conical edge of said lower includes a plurality of circumferentially spaced notches.

4. An athletic boot according to claim 1 wherein said locking means comprises a spring loaded bolt mounted to each of said guides for displacement perpendicularly to the vertical axis thereof, said bolt having inclined teeth constructed and arranged to mesh with inclined teeth formed on one edge of each of said slides to permit free downward displacement of said slides within said guides but to prevent unintentional upward displacement; and retraction means connected to said bolts for intentional disengagement of said teeth whereby said upper may be vertically upwardly displaceable from said lower.

5. An athletic boot according to claim 4 wherein said retraction means comprises a cable interconnecting said bolts around said lower whereby said bolts may be simultaneously retracted by pulling on said cable.

6. An athletic boot according to claim 1 wherein said locking means comprises a lever vertically rotatably mounted to the back of one of said shells; a rack mounted to said lever to slide along a vertical plane in response to rotation of said lever; and cable means having one end connected to said rack and the other end to said slide whereby rotation of said lever in one direction draws said slides and upper downwardly to mate with said lower and rotation of said lever in the opposite direction allows vertical upward displacement of said upper from said lower.

7. An athletic boot according to claim 6 wherein said rack includes a plurality of cable engaging notches and clamp means whereby the length of said cable can be adjusted.

8. An athletic boot according to claim 1 further including an inner liner, said liner having foot encasing area and an ankle encircling area, said ankle encircling area being formed of stretchable material.

* * * * *